US006546855B1

(12) United States Patent
Van Der Beek et al.

(10) Patent No.: US 6,546,855 B1
(45) Date of Patent: Apr. 15, 2003

(54) METHOD FOR OPERATING A SHEARING AND COMPACTING PRESS AND SHEARING AND COMPACTING PRESS

(75) Inventors: August Van Der Beek, Grevenbroich (DE); Günter Bombosch, Datteln (DE); Ottfried Lehmann, Recklinghausen (DE); Jürgen Schalla, Datteln (DE); Walter Fischer, Neuss (DE); Volker Kriese, Castrop-Rauxel (DE)

(73) Assignee: Metso Lindemann GmbH, Düsseldorf (DE)

( * ) Notice: Subject to any disclaimer, the term of this patent is extended or adjusted under 35 U.S.C. 154(b) by 0 days.

(21) Appl. No.: 09/601,849

(22) PCT Filed: Jan. 22, 1999

(86) PCT No.: PCT/DE99/00160

§ 371 (c)(1),
(2), (4) Date: Aug. 23, 2000

(87) PCT Pub. No.: WO99/39900

PCT Pub. Date: Aug. 12, 1999

(30) Foreign Application Priority Data

Feb. 6, 1998 (DE) ..... 198 04 789

(51) Int. Cl.[7] ..... B30B 13/00

(52) U.S. Cl. ..... 100/39; 100/42; 100/98 R; 100/215; 100/218; 100/232

(58) Field of Search ..... 100/232, 218, 100/215, 42, 41, 39, 98 R, 98 A, 95

(56) References Cited

U.S. PATENT DOCUMENTS

| | | | | | |
|---|---|---|---|---|---|
| 4,018,169 | A | * | 4/1977 | Schmalz | 100/215 |
| 4,121,515 | A | | 10/1978 | Tea | 100/98 |
| 4,989,716 | A | * | 2/1991 | Stuckey | 198/311 |
| 5,203,261 | A | * | 4/1993 | Davis | 100/215 |
| 5,317,965 | A | * | 6/1994 | Wildes et al. | 100/232 |
| 5,326,511 | A | * | 7/1994 | Cooper et al. | 264/40.1 |
| 5,505,886 | A | | 4/1996 | Baugh et al. | 264/37 |

FOREIGN PATENT DOCUMENTS

| | | | |
|---|---|---|---|
| DE | 25 21 570 | | 12/1976 |
| DE | 42 10 247 A | | 8/1993 |
| DE | 0267545 | * | 5/1998 |
| EP | 0 267 545 A | | 5/1988 |
| EP | 0 677 367 A | | 10/1995 |

* cited by examiner

*Primary Examiner*—Allen Ostrager
*Assistant Examiner*—Shelley Self
(74) *Attorney, Agent, or Firm*—Norris Mclaughlin & Marcus, P.A.

(57) ABSTRACT

The invention relates to a method and to a shearing and compacting press for the production of pressed parts, preferably packages (20) from waste material, especially scrap and sheet clippings. The material used is pre-compacted in a first compacting step. In a second compacting step, the material, which has been pre-compacted to the width of the package, is subjected to intermediate compacting until the height of the package (20) is reached. In a third compacting step, final compacting of the material to the final width or length of the package (20) is carried out. According to the invention, the material is pre-compacted with a continuos force and optionally sheared until the compressor (3.1) reaches its final position. The compressor (3.2) is securely adjusted and guided to its end position on a parallel plane. Subsequently, the compressor (3.3) is guided in a position in which the compressor (3.1) releases the opening of the package chamber (2.3) when the compressor (3.1) is driven back. Finally, the compressor (3.1, 3.2, 3.3) is subjected to a pressure that is lower than the maximum pressure available in the compressors (3.1, 3.2, 3.3) at the beginning of the working and return strokes. The compressor (3.1) is subjected to maximum pressure for shearing and/or the compressors (3.2, 3.3) are supplied with maximum pressure to end pressing. The invention is also characterized in that the pressing pressure for the compressors (3.1, 3.2, 3.3) is gradually controlled depending on the degree of compression or the corresponding length.

25 Claims, 5 Drawing Sheets a)

b)

METHOD FOR OPERATING A SHEARING AND COMPACTING PRESS AND SHEARING AND COMPACTING PRESS

FIELD OF TECHNOLOGY

The invention relates to a method for operating a shearing and compacting press, as well as a shearing and compacting press for producing pressed parts, in particular packages of scrap metal and sheet clippings.

STATE OF THE PRESENT TECHNOLOGY

Shearing and compacting presses are known which consists essentially of a filling chamber with a shearing edge, a compressor with a shearing knife guided horizontally therein, a pressing chamber arranged perpendicular thereto, and a compressor guided in the pressing chamber, as well as a package chamber which is oriented horizontally and perpendicular to the filling chamber and has a horizontally guided compressor.

In particular embodiments, the filling chamber and the pressing chamber terminate in a common space, which is the above-reference package chamber that receives the package-shaped pressed part. The walls of the filling chamber, the pressing chamber and the package chamber form the housing of the shearing and compacting press. The package chamber has an opening for the door which can be moved horizontally, with the ejected pressed part passing through the door. The compressors and the door are operated by hydraulic pistons/cylinders connected with a hydraulic drive system.

For producing pressed parts, preferably packages, from waste material, in particular from scrap metal and sheet metal clippings, the conventional shearing and compacting presses perform

- a first compacting step for pre-compacting the supplied material to the width of the package using a compressor which is horizontally guided in a filling chamber, wherein any material projecting over the compressor can be cut at a shearing edge using a shearing knife located on the compressor,
- a subsequent second compacting step for intermediate compacting of the material that was previously pre-compacted to the width of the package, to the height of the package using a compressor guided in a pressure chamber in a direction perpendicular to the filling chamber,
- a subsequent third compacting step for final compacting of the material to the final density and/or length of the package using a compressor which is guided in the package chamber horizontally and in a direction perpendicular to the filling chamber, wherein after attaining the final thickness or length, the finished package is ejected from the package chamber through the door, and
- finally controlling the compacting steps through a drive system producing a hydraulic pressure.

The basic principle of the method and the construction of the apparatus have met with success in practical applications. However, it would be desirable to implement additional functional improvements and optimize the design.

SUMMARY OF THE INVENTION

It is the object of the invention to provide a method for operating a shearing and compacting press of the aforedescribed type, wherein the shearing and compacting press achieves a higher utilization rate in particular through cooperation of the compacting steps. The shearing and compacting press should be able to utilize the modified and improved aforedescribed components and subassemblies.

BEST MODE FOR CARRYING OUT THE INVENTION

First, the basic construction of the invention will be described.

Figure 1:
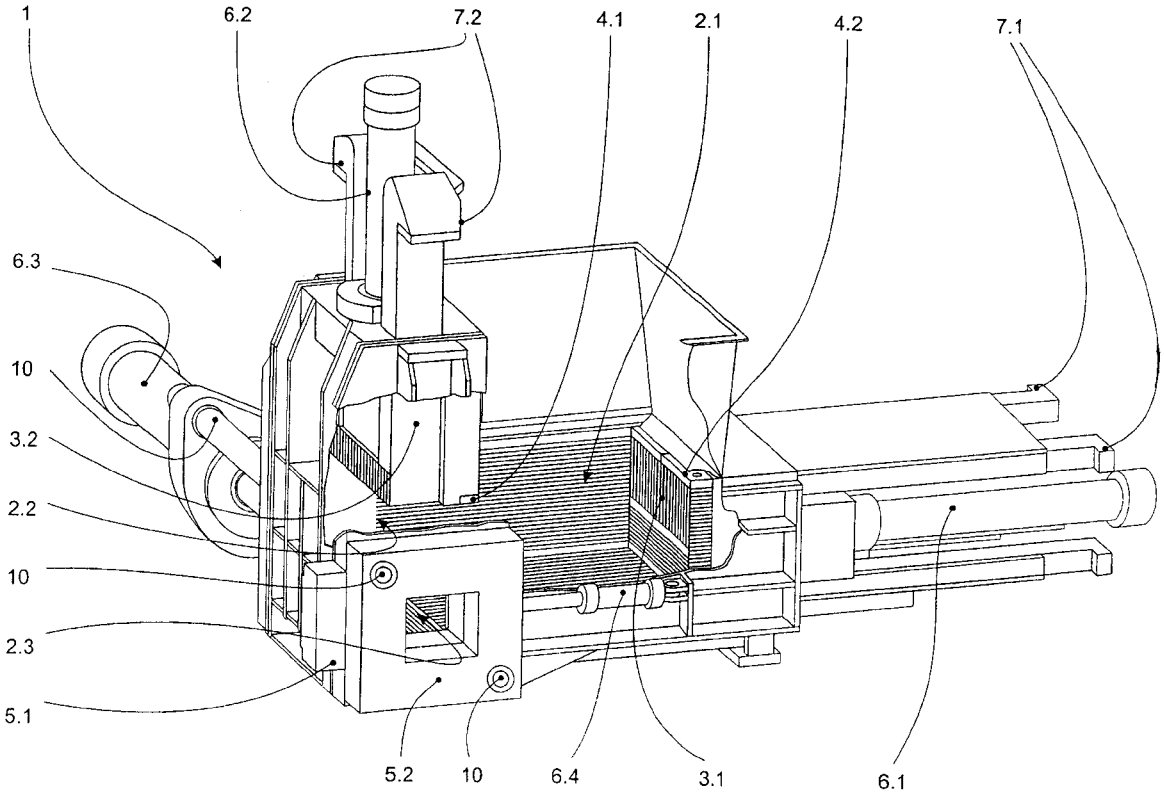
FIG. 1 shows a partially cut-open perspective view of a shearing and compacting press, FIGS. 2*a* and *b* show top views of FIG. 1 with different arrangements of the hydraulic drive system.
Figure 2:
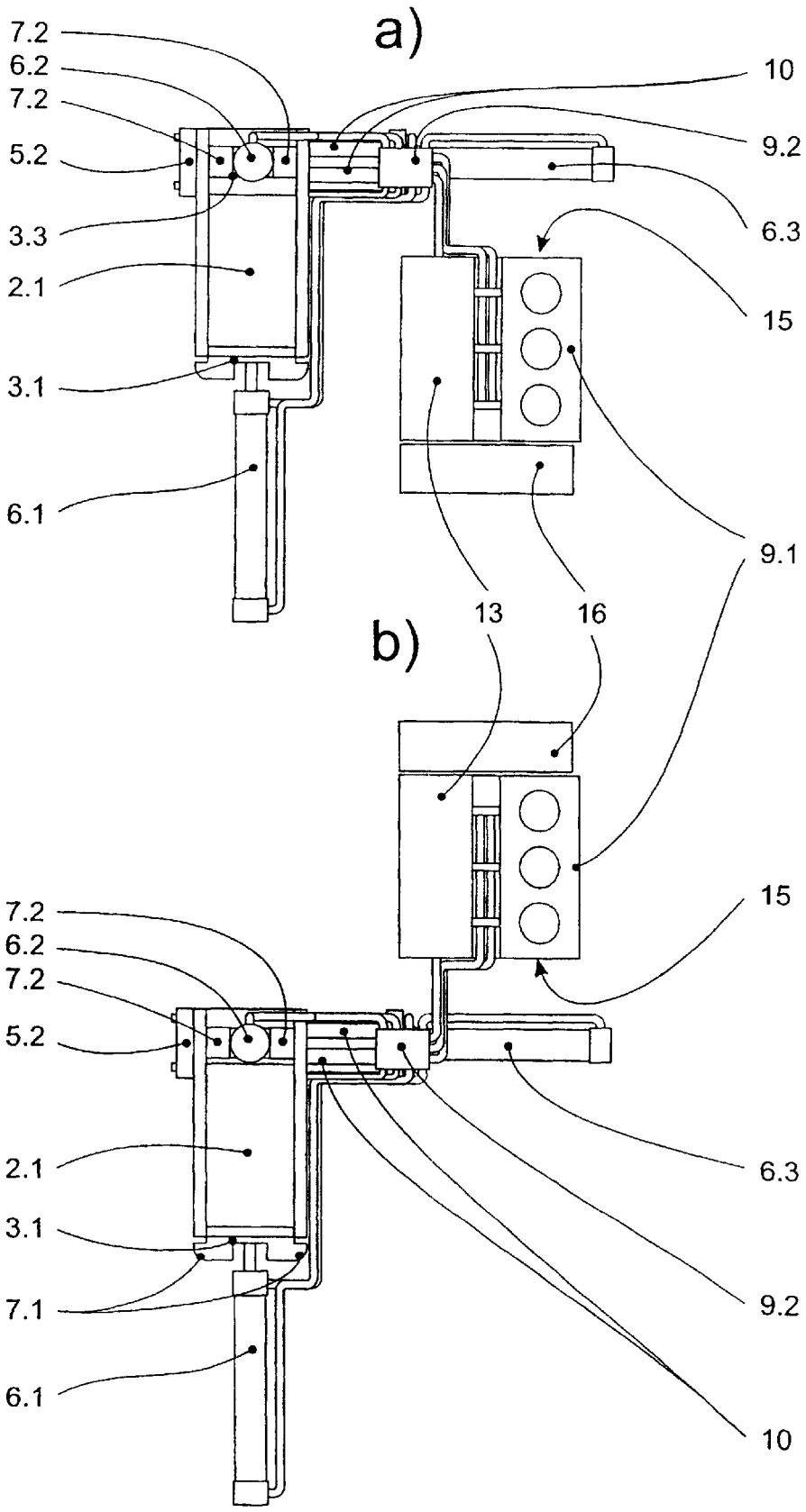
Figure 3:
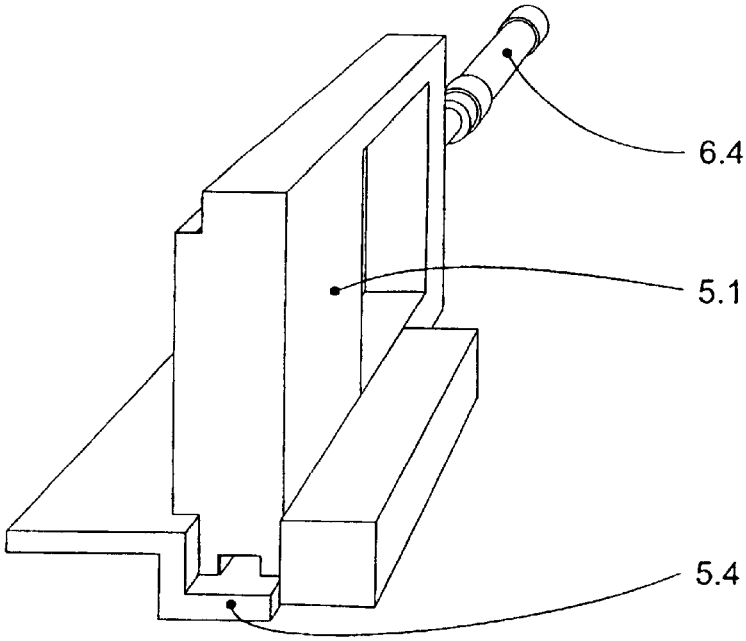
FIG. 3 shows schematically the functional unit door.

Referring now to FIG. 1, the housing of a shearing and compacting press 1 consists of a filling chamber 2.1, a pressing chamber 2.2 and a package chamber 2.3, as well as a compressor 3.1 driven by a piston/cylinder 6.1 and having limit stops 7.1, a compressor 3.2 driven by a piston/cylinder 6.2 and having limit stops 7.2 (FIG. 5), and a compressor 3.3 (FIG. 2*a*). The compressor 3.2 has a shearing edge that cooperates with a shearing knife 4.2. A door 5.1 connected with a piston/cylinder 6.4 is guided in a door casing 5.2 with a lateral guide 5.3 (FIG. 4), for horizontal movement in a lower guide 5.4 (FIG. 3). The door casing 5.2 is secured to the housing portion of the package chamber 2.3 by tension rods 10, with the tension rods 10 simultaneously absorbing the pressure against the door 5.1 which the piston/cylinder 6.3 applies via the compressor 3.3 on the pressed part 20.

FIGS. 2*a*) and *b*) depict different possible arrangements for installing the hydraulic drive system 9.1 of the shearing and compacting press 1. The hydraulic drive system 9.1 includes the control block 9.2, a hydraulic reservoir 13 (FIG. 7), an oil pan 14 (FIG. 7 ) and switch block 16, which together form a compact, preassembled subassembly 15.

Figure 6:
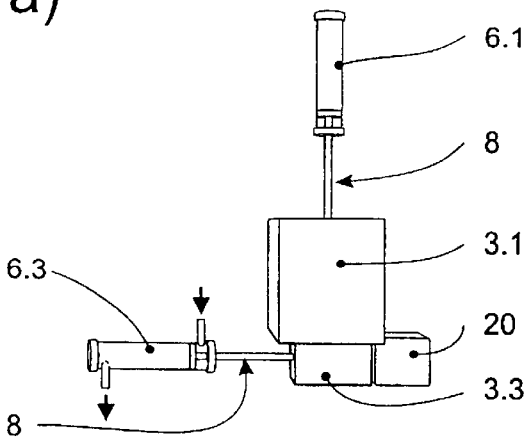
Figure 6:
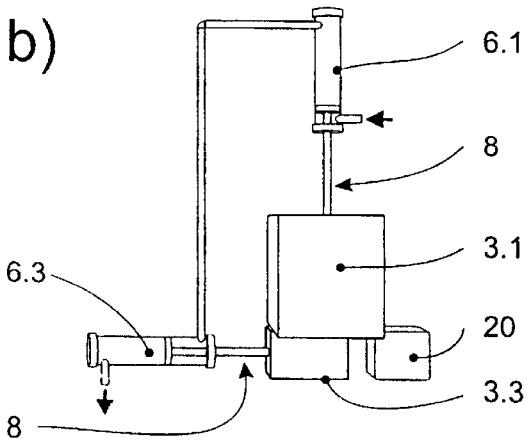
Figure 8:
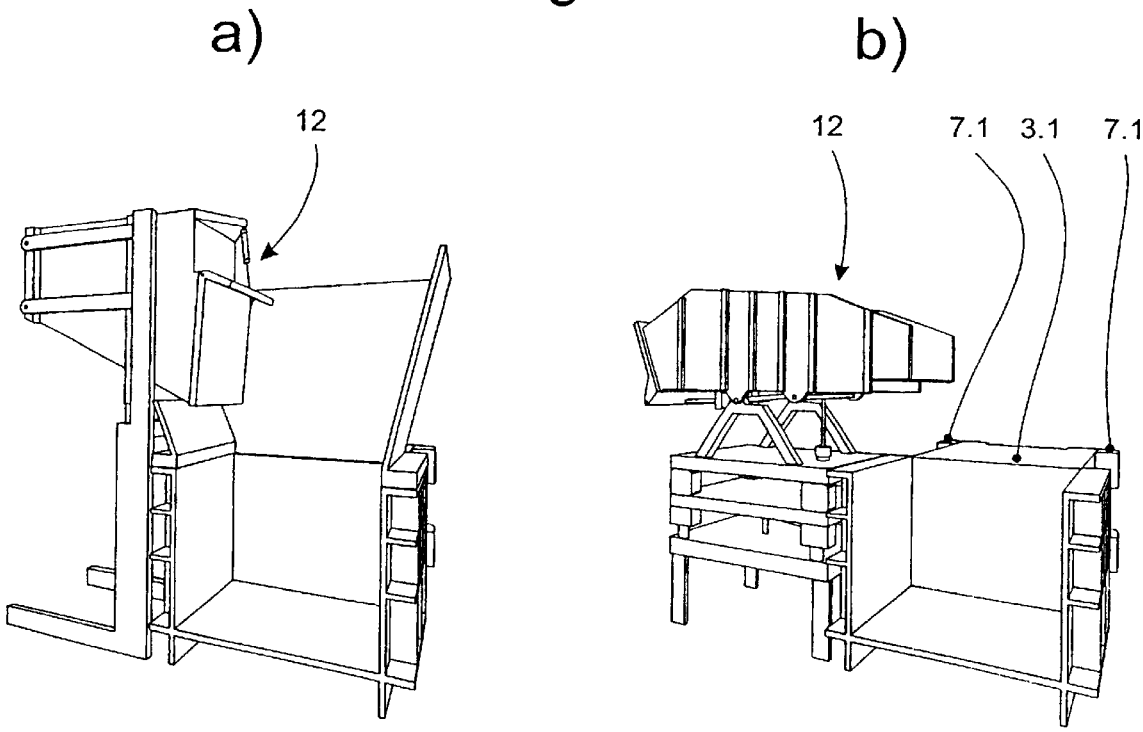
Figure 9:
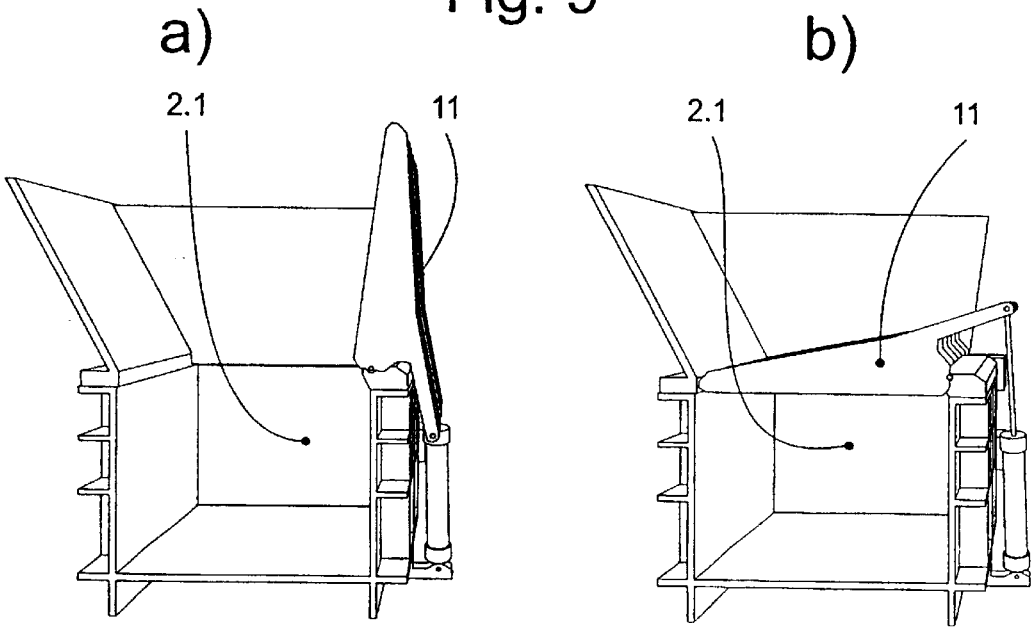

The synergistic operation of the compressor 3.1 and 3.3 illustrated in FIGS. 6*a*) and *b*) creates a respective space which is protected from the potential incursion of falling material to be pressed. FIGS. 8*a*) and *b*) show two modifications of two different metering devices 12 for feeding the material to be processed. FIGS. 9*a*) and *b*) show to positions of a pressing cover 11 for the filling chamber 2.1.

The method according to the invention for operating the shearing and compacting press 1 includes the following basic sequence of steps and/or flows and interactions, after the filling chamber 2.1 has been filled with the material to be pressed by one of the metering devices 12:

- pre-compacting with a continuously applied force and optionally shearing the material by guiding the compressor 3.1 non-adjustably on a parallel plane, thereby eliminating the tilting moment of the compressor 3.1 produced by the shearing operation, until the end position in the first compacting step, in the subsequent second compacting step, non-adjustably guiding the compressor 3.2 in a parallel plane towards the end position of the intermediate compacting operation, guiding the compressor 3.3 in the third compacting step, wherein the compressor 3.1 is already in a position unblocking the operation of the package chamber 2.3 when the compressor 3.3 is returned to a position in which falling material does not interfere with the stroke motion of the compressor 3.3, applying pressure to the respective compressors (3.1, 3.2, 3.3) which for the compressors 3.1, 3.2, 3.3 is below the available maximum pressure at the beginning of the working strokes and the return strokes, and for the compressor 3.1 for the shearing operation and/or for the compressors 3.2, 3.3 provides the maximum attainable pressure at the respective end of the pressing operation, and an automatic control of the pressing pressure for the compressors 3.1, 3.2, 3.3 adapted to the respective degree of compression and the respective length, for the purpose of reliably controlling the functions of the compression process until completion of the final pressing step.

The return strokes of the compressors 3.1, 3.3 are coupled, wherein the compressor 3.3 travels an initial portion of the path by itself and the remaining portion of the path together with the compressor 3.1.

The movements of the compressors 3.1, 3.3 are matched to one another, in that the compressor 3.1 is returned behind the shearing edge 4.1 in order to be able to again feed material into the filling chamber 2.1, only after the compressor 3.3 is on the return stroke from the package chamber 2.3. This arrangement prevents material from entering the space between the pressing plate of the compressor 3.3.

The door 5.1 is closed simultaneously with the return stroke of the compressor 3.3 through hydraulic separation or opened simultaneously with the return stroke of the compressor 3.2 through hydraulic separation.

All these process flows use a measurement system that monitors the movements of the compressors 3.1, 3.2, 3.3 and the door 5.1 as well as the package size, and supplies signals for changing the process flow, such as material feed, package density, applying pressure to the pistons/cylinders 6.1, 6.2, 6.3, 6.4, oil level (leakage).

For this purpose, a control device is employed which drives the compressors 3.1, 3.2, 3.3 and the door 5.1, wherein the control device throughout the initial and intermediate compression steps and until the final compression and ejection of the package 20, records and processes at least one of the following functions before the material is supplied, and optionally intervenes in the process flow:

changing the material feed depending on the material required for the compression process, changing the pressing pressure of at least one of the compressors 3.1, 3.2, 3.3 depending on the pressing pressure required for the respective compression step, changing the travel path of the compressors 3.1, 3.2, 3.3 depending on at least one of the set values, such as width, height and/or length, as well as density of the package 20, increase in weight of the supplied material per unit time (gradient).

For this purpose, a hydraulic system is employed which drives the compressors 3.1, 3.2, 3.3 and the door 5.1 using the hydraulic drive system 9.1, the pistons/cylinders 6.1, 6.2, 6.3, 6.4 and control blocks 9.2. The hydraulic system includes an available maximum pressure, valves controlled and sized depending on the process steps, hydraulic circuits separated by a valve in the respective section of the control block 9.2 and adapted for simultaneous processes requiring different oil quantities, coupling of operations using a fixed predetermined oil transfer, a monitoring system for identifying leaks in the hydraulic system, a compact control block 9.2 for the compressor 3.3 disposed above or adjacent to the piston/cylinder 6.3, and electronic distance measurement devices/sensors which are associated with and/or integrated with the pistons/cylinders 6.1, 6.2, 6.3.

A control device processes the signals of the distance measurement devices for weighing/feeding the material for the purpose of monitoring the package size/density for a pre-selectable package length and/or package density.

Advantageously, a control device with alarm devices is employed which can disconnect the control devices which control the compacting steps, when the compressors 3.1 and/or 3.2 fail to reach their respective end positions. during maintenance/repair, at least one of the compressors 3.1, 3.2, 3.3 is moved into a position so that the space required for the maintenance/repair, in particular for exchanging the wear lining, is accessible without requiring removal of one of the compressors 3.1, 3.2, 3.3.

The method to be implemented requires a combination of features according to the invention, so that the shearing edge 4.1 and the edge of the shearing knife 4.2, as viewed from the top, form a triangle at the start of the shearing process, the compressor 3.1 is guided so as not to be subjected to a tilting torque and has non-adjustable limit stops 7.1 (FIG. 1) which form a guide for attaining the end position in a parallel plane, the compressor 3.2 is provided with non-adjustable limit stops 7.2 which form a guide for attaining the end position in a parallel plane, and the length of the compressor 3.3 is selected so that material falling down during the return stroke of the compressor 3.3 cannot enter a space 8 surrounding the piston/cylinder 6.1, 6.3 (FIG. 6 *a*), *b*)).

Moreover, the full available pressure of the hydraulic drive system 9.1 can be applied to the compressors 3.1, 3.2, 3.3 during the respective pressing process, whereas during the simultaneous movement of the compressors 3.1, 3.2, 3.3, the active pump circuits of the compressors 3.1, 3.2, 3.3 are hydraulically separated in the respective control block 9.2 from at least one of the compressors 3.1, 3.2, 3.3 and/or the door 5.1 through a valve, and the movement of at least one of the compressors 3.1, 3.2, 3.3 is coupled with that of another compressor 3.1, 3.2, 3.3 by a fixed predetermined transfer of oil.

It is important in the newly designed system that the door 5.1 contacts the housing of the package chamber 2.3 with a tension force determined by tension rods 10 so as to absorb the pressing force of the compressor 3.3, wherein the pressing forces are static forces absorbed between the compressor 3.3 and the tension rods 10.

For enhancing the synergy of the construction, the door 5.1 is guided by a door casing 5.2 in the form of a closed frame. The tension rods 10 oppose each other and extend diagonally on corners along the pressing chamber 2.3, providing additional support for the door casing 5.2 which is attached to the housing portion of the package chamber 2.2.

Advantageously, the guides 5.3, 5.4 of the door 5.1 are designed to be self-cleaning.

All lubrication bores are arranged in such a way that they cannot be blocked by abraded material.

For improved functionality, the piston/cylinder 6.4 effecting opening and closing of the door 5.1 is disposed in the center of the cross-section of the door 5.1.

In an advantageous space-saving arrangement, the piston/cylinder 6.4 is integrated next to the compressor (3.1) and the side wall of the housing of the filling chamber 2.1.

To facilitate the filling process, a pressing cover 11 can be provided on the filling chamber 2.1.

A continuous production of pressed parts (20) of approximately equal mass is facilitated by a metering device 12 which can be formed as a container scale (FIG. 8*a*) or a trough-tipping scale (FIG. 8*b*).

Figure 7:
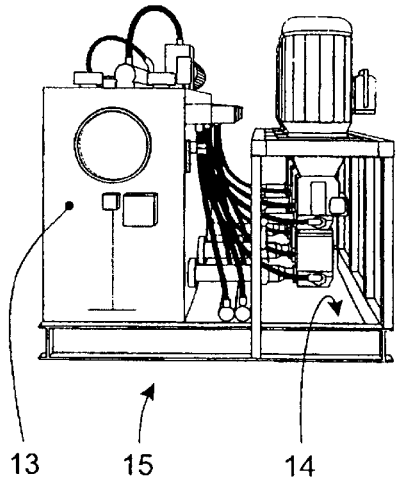
FIG. 7 is a perspective view of the compact drive unit alone, FIGS. 8*a* and *b* show two embodiments of a metering device of the cut-open filling chamber of the shearing and compacting press, and FIGS. 9*a* and *b* show the cut-open filling chamber with two different positions of the pressing cover.

All guides, in particular the guides of the compressors 3.1, 3.2, 3.3 and of the door 5.1, are connected with a central, automatically controlled lubrication system 21 through lubrication lines 22 (FIG. 7).

Figure 4:
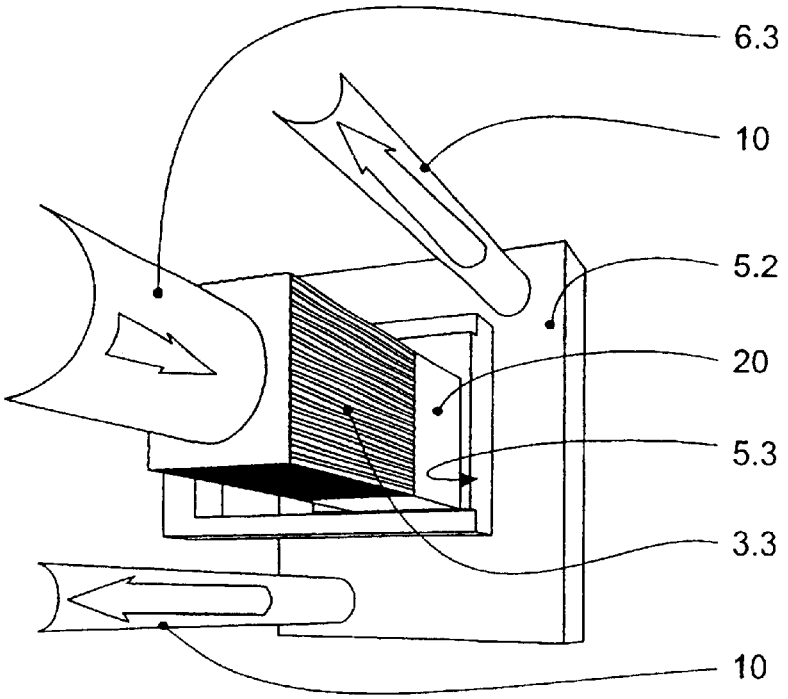
FIG. 4 shows schematically the arrangement of the forces in the region of the functional unit door.
Figure 5:
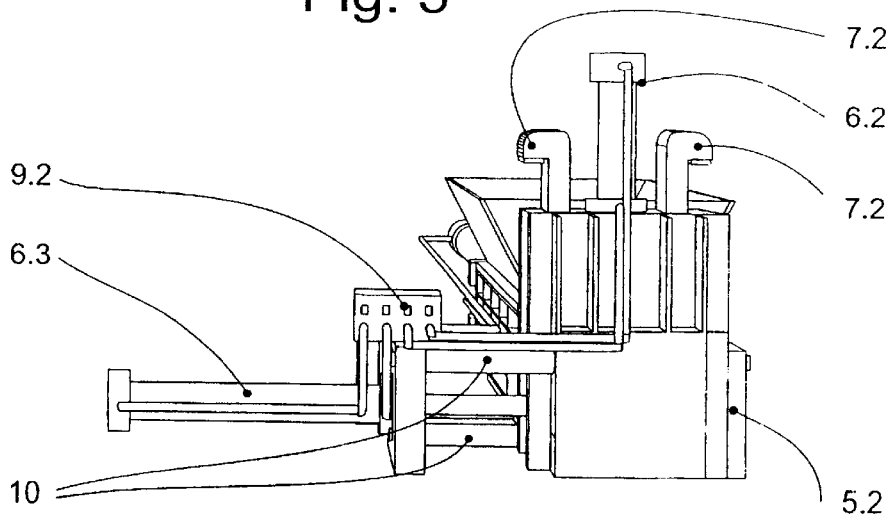
FIG. 5 is a view from the left side of the shearing and compacting press of FIG. 1, FIGS. 6*a* and *b* are two schematic illustrations depicting the cooperation of the first and third compressor.

Using a wash-board-type profile for wear part linings enables mechanical separation of interfering material of all types and shapes (FIG. 1, FIG. 4).

An installation which reduces the required base area and the area for the foundation, is provided by an arrangement, wherein the compact hydraulic control block 9.2 is directly associated with the shearing and compacting press 1, the hydraulic tank 13 and the hydraulic drive system 9.1 and/or the lubrication system for automatic lubrication form a pre-assembled subassembly 15, which rests on a frame-like oil pan 14, and a control box 16 is associated with the subassembly 15.

Advantageously, the subassembly 15 is arranged in the angle enclosed between the filling chamber 2.1 and the piston/cylinder 6.3 of the compressor 3.3.

The shearing and compacting press according to the invention, with respect to both the method of operation and the product, provides for an operator an increased service value for the following reasons:

automatic continuous or single-event operation, for producing the pressed parts or only a single pressed part, tamping operation, wherein the compressor 3.1 pushes the material together and then again unblocks the fill opening, manual operation allowing separate movement of the pistons/cylinders 6.1, 6.2, 6.3, with electric interlocking of the sequence of steps, and a reasonable repair process flow.

The pressing pressure of the compressors 3.1, 3.2, 3.3 can be adjusted in steps, allowing production of pressed parts with optimized high density, without requiring unnecessary time and energy to establish the pressing pressure.

Industrial Applicability

The invention as a whole contributes to reduce the investment and the costs for operating the machine, and in addition shortens the cycle times of the shearing and compacting press and increases the productivity and the quality in the production of pressed parts.

What is claimed is:

1. A method for operating a shearing and compacting press for producing a pressed package from waste material, comprising the steps of:

a first compacting step for pre-compacting supply material to a predetermined width of the pressed part using a first compressor which is non-adjustably guided substantially horizontally on a substantially parallel plane in a filling chamber at a continuously applied force, supply material projecting over the first compressor is sheared when the first compressor and a shearing knife disposed thereon are moved towards so as to contact a shearing edge shearing excess supply material therebetween, the substantially parallel plane substantially eliminating tilting movement of the first compressor during shearing until a final position of the first compacting step;

a second compacting step for intermediate compacting the supply material that has been pre-compacted to the width of the pressed part to a predetermined height of the pressed part using a second compressor non-adjustably guided along a substantially parallel plane in a pressure chamber in a direction substantially perpendicular to the filling chamber towards an end position of the second compacting step;

a third compacting step for final compacting of the supply material to a predetermined length of the pressed part using a third compressor guided in a package chamber substantially horizontally and in a direction substantially perpendicular to the filling chamber, the first compressor being in a position unblocking an opening of the package chamber when the third compressor is returned to a position in which falling material does not interfere with stroke movement of the third compressor, wherein the first, second and third compacting steps are controlled by a drive system producing a hydraulic pressure; and ejecting the pressed part through the opening of the package chamber; wherein pressure applied to the respective compressors at the beginning of stroke movement and during return strokes is below a maximum available pressure, a maximum attainable pressure being applied to at least one of: (i) the first compressor during shearing operation and (ii) the second and third compressors at end positions of the respective pressing operations; and automatically controlling the pressing pressure for the compressors based on a degree of compression and the respective length of the pressed package so as to control the compression process until the third compacting step is completed.

2. The method according to claim 1, wherein the return strokes of the first and third compressors are coupled, wherein the third compressor travels an initial portion of a displacement path by itself and a remaining portion of the path together with the first compressor.

3. The method according to claim 2, wherein the movements of the first and third compressors are matched to one another so that the first compressor is returned behind the shearing edge to permit material to be fed again into the filling chamber only after the third compressor on the return stroke in the package chamber is in a region which prevents material from entering a space behind the third compressor.

4. The method according to claim 3, wherein the opening of the package chamber is closed off by a door, the door being closed simultaneously with the return stroke of the third compressor via hydraulic separation.

5. The method according to claim 4, wherein an opening of the package chamber is closed off by a door, the door being opened simultaneously with the return stroke of the second compressor via hydraulic separation.

6. The method according to claim 5, further comprising a piston/cylinder associated with each compressor; and a measurement system for monitoring movements of the compressors, movement of the door and the pressed package size; the measurement system supplies signals for changing at least one of material feed, package density, pressure applied to the pistons/cylinders and oil level leakage.

7. The method according to claim 6, further comprising a control device for driving the compressors and the door, the control device during the first, second and third compacting steps and ejection of the package is recording and processing at least one of the following functions before the supply material is supplied:

a) changing the material supply depending on the material required for the compacting process, b) changing the pressing pressure of at least one of the compressors depending on the pressing pressure required for the respective compression step, c) changing the travel path of the compressors depending on at least one of width, height, length and density of the pressed package, d) increasing in weight of the supply material per unit time.

8. The method according to claim 7, further comprising a hydraulic system for driving the compressors and the door, using a hydraulic drive system, the pistons/cylinders and control blocks, wherein the hydraulic system comprises:

a) an available maximum pressure, b) valves controlled and sized depending on the process steps, c) hydraulic circuits separated by a valve in a respective section of the control block and adapted for simultaneous processes requiring different oil quantities, d) coupling of operations using a fixed predetermined oil transfer, e) a monitoring system for identifying leaks in the hydraulic system, f) the control block controls the third compressor and is disposed above or proximate to the piston/cylinder associated with the third compressor, and g) electronic distance measurement devices/sensors which are associated with and/or integrated with the respective pistons/cylinders.

9. The method according to claim 8, further comprising a control device that processes signals received from distance measurement devices for weighing/feeding the supply material so as to monitor the pressed package size/density for a pre-selectable package length and/or package density.

10. The method according to claim 9, wherein the control device includes an alarm device for disconnecting the control devices that control the compacting steps, when at least one of the first and third compressors fail to reach their respective end positions during the respective compacting operation.

11. The method according to claim 10, further comprising the step, during maintenance/repair, moving at least one of the compressors into a position so that a space required for exchanging of a wear lining, is accessible without removal of one of the compressors.

12. A shearing and compacting press, comprising:

a filling chamber having a shearing edge;

a first compressor including a shearing knife, the first compressor being guided horizontally in the filling chamber, wherein at a start of the shearing process when viewed from the top, the shearing edge and edge of the shearing knife form a triangle;

a pressing chamber arranged substantially perpendicular to the filling chamber;

a second compressor guided in the pressing chamber along a substantially parallel plane, the second compressor having limit stops as a guide for reaching an end compacting position;

a package chamber oriented horizontally and substantially perpendicular to the filling chamber; the package chamber having an opening through which a pressed package is ejected therethough; the filling chamber and the pressing chamber terminating in a common space of the package chamber that receives the pressed package; walls of the filling chamber, the pressing chamber and the package chamber forming a housing of the shearing and compacting press;

a third compressor substantially horizontally guided in the package chamber, a length of the third compressor being selected so that during return stroke, falling material is prevented from entering a space surrounding the pistons/cylinders associated with the first and third compressors, wherein pressure applied to the respective compressors at the beginning of stroke movement and during return strokes is below a maximum available pressure, a maximum attainable pressure being applied to at least one of: (i) the first compressor during shearing operation and (ii) the second and third compressors at end positions of the respective pressing operations;

a door moveable in a substantially horizontal direction to close off the opening of the package chamber;

each compressor and the door having an associated piston/cylinder for displacement of the respective compressor; and a hydraulic drive system connected so as to displace the compressors and door via the associated pistons/cylinders.

13. The shearing and compacting press according to claim 12, wherein during simultaneous movement of the compressors, active pump circuits of the compressors are hydraulically separated in a respective control block from at least one of the door and at least one of the compressors by a valve, movement of one of the compressors is coupled with that of another compressor by a fixed predetermined transfer of oil.

14. The shearing and compacting press according to claim 13, wherein the door includes tension rods defining tension of the door on the package chamber and absorbing static pressure forces between the third compressor and the tension rod.

15. The shearing and compacting press according to claim 14, wherein the door is guided by a closed frame door casing having guides, the tension rods oppose each other and extend diagonally on comers along the package chamber providing additional support for the door casing attached to a housing of the package chamber.

16. The shearing and compacting press according to claim 14, wherein the guides are self-cleaning.

17. The shearing and compacting press according to claim 16, wherein lubrication bores are arranged so as not to be blocked by abraded material.

18. The shearing and compacting press according to claim 14, wherein the piston/cylinder effecting opening and closing of the door is disposed substantially centered of the cross-section of the door.

19. The shearing and compacting press according to claim 18, wherein the piston/cylinder effecting opening and closing of the door is arranged integrated with the first compressor and a side wall of a housing of the filling chamber.

20. The shearing and compacting press according to claim 18, further comprising a pressing cover provided on the filling chamber.

21. The shearing and compacting press according to claim 20, further comprising a metering device arranged before the filing chamber for continuously producing pressed packages of approximately equal mass.

22. The shearing and compacting press according to claim 21, each compactor having a guide, further comprising a central automatically controlled lubrication system for connecting the guides of the compressors and of the door via lubrication lines.

23. The shearing and compacting press according to claim 12, wherein the compressors have a wash-board-type profile wear part lining for separating out interfering material of all types and shapes.

24. The shearing and compacting press according to claim 12, further comprising:

a control block directly associated with the shearing and compacting press;

a pre-assembled subassembly comprising a hydraulic tank and at least one of the hydraulic system and a lubrication system for automatic lubrication, the pre-assembled subassembly resting on an oil pan; and a switch box associated with the subassembly.

25. The shearing and compacting press according to claim 24, wherein the subassembly is arranged in an angle defined between the filling chamber and the piston/cylinder associated with the third compressor.

* * * * *